US009074470B2

(12) United States Patent
Teichrob

(10) Patent No.: US 9,074,470 B2
(45) Date of Patent: Jul. 7, 2015

(54) METHODS FOR DRILLING AND STIMULATING SUBTERRANEAN FORMATIONS FOR RECOVERING HYDROCARBON AND NATURAL GAS RESOURCES

(75) Inventor: Robert Teichrob, Calgary (CA)

(73) Assignee: Seven Generations Energy Ltd., Calgary (CA)

( * ) Notice: Subject to any disclaimer, the term of this patent is extended or adjusted under 35 U.S.C. 154(b) by 0 days.

(21) Appl. No.: 13/976,288

(22) PCT Filed: Dec. 22, 2011

(86) PCT No.: PCT/CA2011/001387

§ 371 (c)(1), (2), (4) Date: Jul. 25, 2013

(87) PCT Pub. No.: WO2012/088586

PCT Pub. Date: Jul. 5, 2012

(65) Prior Publication Data

US 2013/0312973 A1 Nov. 28, 2013

Related U.S. Application Data

(60) Provisional application No. 61/460,195, filed on Dec. 27, 2010.

(51) Int. Cl.
*E21B 43/26* (2006.01)
*E21B 7/00* (2006.01)

(52) U.S. Cl.
CPC .. *E21B 43/26* (2013.01); *E21B 7/00* (2013.01)

(58) Field of Classification Search
CPC ..... E21B 43/26; E21B 7/00
USPC ..... 166/308.1–308.6, 307, 250.01
See application file for complete search history.

(56) References Cited

U.S. PATENT DOCUMENTS

2009/0151938 A1 6/2009 Conkle et al.
2012/0125619 A1 * 5/2012 Wood et al. ..... 166/308.1

OTHER PUBLICATIONS

Nickitas-Etienne, Athina "International Preliminary Report on Patentability" The International Bureau of WIPO; Jul. 2, 2013; pp. 1-4.

* cited by examiner

*Primary Examiner* — Yong-Suk (Philip) Ro
(74) *Attorney, Agent, or Firm* — Bradley Arant Boult Cummings LLP

(57) ABSTRACT

A method of drilling and stimulating subterranean formations is provided that allows a well operator to determine in real time if a fracture treatment has been successful, and whether the fracture treatment composition is sufficient for subsequent fracking. The method involves placing fracture treatments into a wellbore while the drilling operation is still under way. The fracture treatment is bounded in the open hole on one side by the current end of the hole and on the other side by a temporary pack off isolation fluid that has been introduced to the well by way of pumping down the existing drill string or by pumping down a separate frac string. The objective is to place the frac in the reservoir and flow it back very quickly after placement, thus increasing the chances of flowing back harmful formation damaging materials and increasing the relative productivity of the newly placed fracture treatment.

1 Claim, 20 Drawing Sheets

METHODS FOR DRILLING AND STIMULATING SUBTERRANEAN FORMATIONS FOR RECOVERING HYDROCARBON AND NATURAL GAS RESOURCES

CROSS-REFERENCE TO RELATED APPLICATIONS

This application is a national stage under 35 U.S.C. 371 of International Application PCT/CA2011/001387, filed on Dec. 22, 2011 (currently pending). International Application PCT/CA2011/001387 cites the priority of U.S. Patent Application 61/460,195, filed Dec. 27, 2010.

FIELD OF THE INVENTION

The present invention relates to the drilling and stimulating of subterranean rock formations for the recovery of hydrocarbon and natural gas resources. In particular, the present invention relates to a method of fracture treating a wellbore while the drilling operation is underway.

BACKGROUND

Subterranean reservoir rock formations that contain hydrocarbons and gases are often, if not usually, horizontal in profile. It was therefore of immense economic value and a great benefit to society when modern drilling techniques were developed that could create horizontal wellbores from a vertical well over a distance to gain access to a larger portion of hydrocarbon and natural gas resources in a reservoir.

A problem to overcome, however, was that such horizontal reservoirs (for instance, shale formations), are generally quite tight and compressed in nature, meaning that they often don't contain natural fractures of sufficient porosity and permeability within the formation through which hydrocarbons and gas can readily flow into the well at economic rates. Engineers, however, were able to develop methodologies whereby rock formations can be "perfed" (perforated) and "fracked" (fractured) to create pathways in the rock formations through which hydrocarbons and gas can much more readily flow to the well.

While such fracking has led to a great increase in the amount of hydrocarbons and gas that can be readily recovered from a formation, engineers found that it was important to be able to isolate one fracture from another so that the same part of the well was not being repeatedly fractured. Repeated fracturing can cause rock chips and fine rock particles to enter cracks and pore space, thereby reducing the porosity and permeability of the fracked area into the well. The same is true for vertical or deviated wells.

In the known methodology, drilling, and perfing and fracking rock formations involves separate operations. In particular, the well is drilled first, and then the drilling rig is moved off location before a fracturing "spread" is moved on to the location to perf and frac the wellbore for the subsequent recovery of hydrocarbon or natural gas resources. The timing between the drilling of the well and the fracture treatment of the same well can vary from immediately thereafter to as much as 18 months depending on the availability of frac equipment which is in high demand. There are therefore several inefficiencies in the known methods of resource recovery.

It is useful to more fully discuss the conventional drilling and fracking methodology in order to assist in distinguishing the method of the present invention.

Conventional Drilling

A drill bit(s) is mounted on the end of a drill pipe, and a mixture of water and additives ("mud") is pumped into the hole to cool the bit and flush the cuttings to the surface as the drill bit(s) grinds away at the rock. This mud generally cakes on the walls of the wellbore, which assists in keeping the well intact. The hole is generally drilled to just under the deepest fresh water reservoir near the surface, where the drill pipe is then first removed. Surface casing is then inserted into the drilled hole to a point below the water reservoir in order to isolate the fresh water zone. Cement is subsequently pumped down the casing, exits through an opening called a shoe at the bottom of the casing and wellbore, and is then forced up between the outside of the casing and the hole, effectively sealing off the wellbore from the fresh water. This cementing process prevents contamination of the freshwater aquifers. The drill pipe is then lowered back down the hole to drill through the plug and cement and continue the vertical section of the well. At a certain depth above the point where a horizontal well is desired (the "kick-off point" or "KOP"), the well will slowly begin to be drilled on a curve to the point where a horizontal section can be drilled. The KOP is often located approximately 220 meters above the planned horizontal leg. Up to this point, the process is the same as drilling a vertical well.

Once the KOP is reached, the pipe and bit are pulled out of the hole and a down hole drilling motor with measurement drilling instruments is lowered back into the hole to begin the angle building process. In general, it takes approximately 350 m of drilling to make the curve from the KOP to where the wellbore becomes horizontal (assuming an 8° angle building process, for instance). Then, drilling begins on the "lateral", the well's horizontal section.

When the targeted horizontal drilling distance is reached on the lateral, the drill bit and pipe are removed from the wellbore. Production casing is then inserted into the full length of the wellbore. Cement is again pumped down the casing and out through the hole in the casing shoe, forcing the cement up between the outside of the casing and the wall of the hole, thus filling the "annulus", or open space. At this point, the drilling rig is no longer needed so this equipment is moved off-site and a well head is installed. The fracturing or service crew then moves its equipment on-site to prepare the well for production and the recovery of hydrocarbon and gas resources.

Conventional Perfing and Fracking of the Wellbore

The first step in the known method is to perf the casing. In this respect, a perforating gun is lowered by wire line into the casing to the targeted section of the horizontal leg (i.e. in general, to the end of the lateral so that the process can work back along the horizontal leg from the "toe" to the "heel" of the wellbore). An electrical current is sent down the wire line to the perf gun, which sets off a charge that shoots small evenly-spaced holes through the casing and cement and out a short distance into the rock formation (often shale). This causes fractures in the rock formation, but is generally not sufficient in itself to create proper fairways through which hydrocarbons or gas can readily flow into the wellbore due to the tight or compressed nature of the rock formation (as previously stated, compressed reservoirs do not generally contain natural fractures and therefore hydrocarbons or gas cannot be produced economically without additional manipulation). As a result, a further step is needed to increase the porosity and permeability of the rock by providing more significant pathways through which the hydrocarbons or gas can flow more readily. To do this, the perf gun is removed from the hole, and the well then needs to be "fracked" to create proper fairways.

Fracking (or fracing) is the process of propagating the fracture in the rock layer caused by the perforation in the formation from the perf gun. In this respect, it is hydraulic fracturing that is usually undertaken, which is the process whereby a slurry of, for example, mainly water, and some sand and additives are pumped into the wellbore and down the casing under extremely high pressure to break the rock and propagate the fractures (sufficient enough to exceed the fracture gradient of the rock). In particular, as this mixture is forced out through the vertical perforations caused by the perf gun and into the surrounding rock, the pressure causes the rock to fracture. Such fracturing creates a fairway, often a tree-like dendritic fairway, that connects the reservoir to the well and allows the released hydrocarbons or gas to flow much more readily to the wellbore. Once the injection has stopped, often a solid proppant (e.g. silica sand, resin-coated sand, man-made ceramics) is added to the fluid and injected to keep the fractures open. The propped fractures are permeable enough to allow the flow of hydrocarbons or gas to the well.

In order for the next section of the horizontal leg to be perforated and fracked (i.e. multi-stage fracking from the "toe" all along to the "heel" of the horizontal leg), a temporary plug is placed at the nearest end of the first-stage frac to close off and isolate the already perforated and fracked section of the wellbore. The process of perfing, fracking, and plugging is then repeated numerous times until the entire horizontal distance of the wellbore is covered. Once such a process has been completed, the plugs are drilled out, allowing the hydrocarbons or gas to flow up the wellbore to a permanent wellhead for storage and distribution. Unfortunately, in this known method, a well operator is unable to determine whether any particular fracture treatment has been successful in increasing the porosity and permeability of the rock formation at a given location of the wellbore, whether the treatment is having a net positive or negative effect on overall flow of hydrocarbons or gas into the well, and whether a modification to the fracturing fluid/slurry, for example, would have produced better results.

Persons skilled in the art would be aware of other similar or related completion methodologies that have the same limitations. For instance, engineers may employ an open hole completion where no casing is cemented in place across the horizontal production leg. Pre-holed or slotted liners/casing may be employed across the production zone. Swellable/inflatable elastomer packers may be used, for instance, to provide zonal isolation and segregation, and zonal flow control of hydrocarbons or gas. Perfing may be accomplished by perforating tools or by a multiple sliding sleeve assembly, etc. Regardless, the methodologies operate in essentially the same manner—the operation proceeds from the "toe" of the well back to the "heel", and the well operator is unable to determine whether any particular fracture treatment has been successful in increasing the porosity and permeability of the rock formation at any given location of the wellbore, whether the treatment is having a net positive or negative effect on overall flow of hydrocarbons or gas into the well, and whether a modification to the fracturing fluid/slurry, for example, would have produced better results.

A method that would allow for the creation of fracture treatments into a wellbore while the drilling operation is under way would overcome several problems and inefficiencies associated with the known hydrocarbon and gas recovery process in the oil and gas industries.

SUMMARY OF THE INVENTION

The method of the present invention involves placing fracture treatments into a wellbore while the drilling operation is still under way (drilling ahead). The fracture treatment is bounded in the open hole on one side by the current end of the hole and on the other side by a temporary pack off isolation fluid that has been introduced to the well by way of either pumping down the existing drill string or by pumping down a separate frac string. In particular, the drill string or frac string remains in the wellbore, and the annulus between same and the wellbore is packed off with the temporary isolation fluid/material. The objective is to place the frac in the reservoir and flow it back very quickly after placement, thus increasing the chances of flowing back harmful formation damaging materials and increasing the relative productivity of the newly placed fracture treatment (compared to conventionally placed fracs).

Drilling then continues (with hydrocarbon and gas resources being recoverable even at this early stage) and fractures can be placed as closely to one another as practical. This is only limited by the effectiveness of the isolation fluid/material given the pressure created at the fracture site (called fracture initiation pressure) in the context of the subterranean formation at issue—the better the isolation fluid/material works, the shorter the required distance between fracture intervals. In this manner, multi-stage fractures can be placed in a wellbore as the well is drilled ahead, each one contributing cumulatively as the wellbore length is increased.

The net effect of the method of the present invention is that the well operator is able to determine in real time if a fracture treatment has been successful, including whether the fracture treatment composition is sufficient/should be changed, and whether this is having a net positive or negative effect on overall flow of the hydrocarbons or gas into the well. Based on the composition of the inflow up the well, the operator may determine, for instance, that the frac treatment has been effective or may determine that a different fracturing fluid/slurry should be employed for subsequent frac treatments based on the rock formation encountered. This is to be distinguished from conventional fracking techniques where there is no real time feedback, no way to know whether a proper fracturing fluid/slurry was used at a particular stage/site, and no way for an operator to know what must be done to improve performance.

Finally, this "Frac Ahead" process allows the operator to place multiple fractures (much like the dendritic pattern observed in leaf patterns) in multi lateral wellbores, thereby increasing swept reservoir volume to a previously unattainable level.

According to one aspect of the present invention, there is provided a method of drilling and completing a wellbore in a subterranean formation for the recovery of hydrocarbon or natural gas resources comprising the steps of:

(i) drilling an intermediate wellbore in a subterranean formation by means of a drill string;

(ii) inserting a frac string into the wellbore and pumping into the wellbore through an opening in the frac string an isolation fluid that is sufficient to withstand fracture initiation pressure;

(iii) pumping into the wellbore through an opening in the frac string a frac fluid at a pressure sufficient to create fractures in the subterranean formation in the vicinity of the end of the frac string;

(iv) removing the frac string from the wellbore;

(v) inserting the drill string into the wellbore and through the isolation fluid to flow any residual frac fluid and the isolation fluid back out of the wellbore; and (vi) extending the wellbore by means of the drill string, whereby hydrocarbon or natural gas resources may flow from the fractures into the wellbore for the recovery thereof while drilling proceeds, and whereby steps (ii) to (vi) may be repeated throughout the entire length of the wellbore to create multi-fractured zones in the wellbore that cumulatively add to the recovery of hydrocarbon or natural gas resources.

Other aspects and features of the present invention will become apparent to those ordinarily skilled in the art upon review of the following description of exemplary embodiments in conjunction with the accompanying figures.

BRIEF DESCRIPTION OF THE DRAWINGS

Embodiments of the present invention will now be described, by way of example only, with reference to the attached figures, wherein.

The same reference numerals are used in different figures to denote similar elements.

DETAILED DESCRIPTION

The method of the present invention is generally used in horizontal wells but can also be used on vertical or deviated wells.

Figure 1:
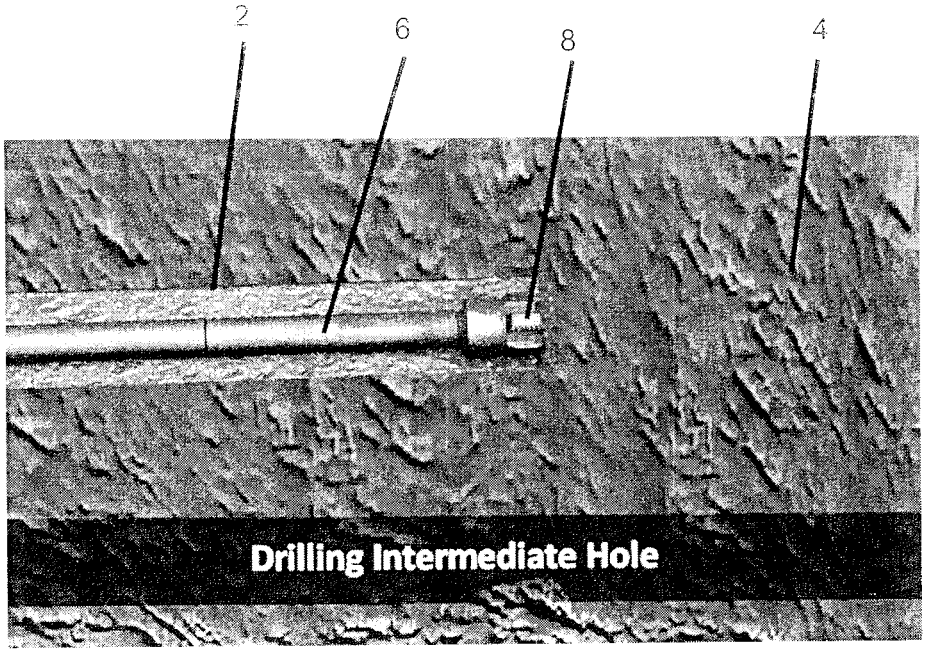
FIG. 1 is a diagram showing the drilling of an intermediate hole.
Figure 2:
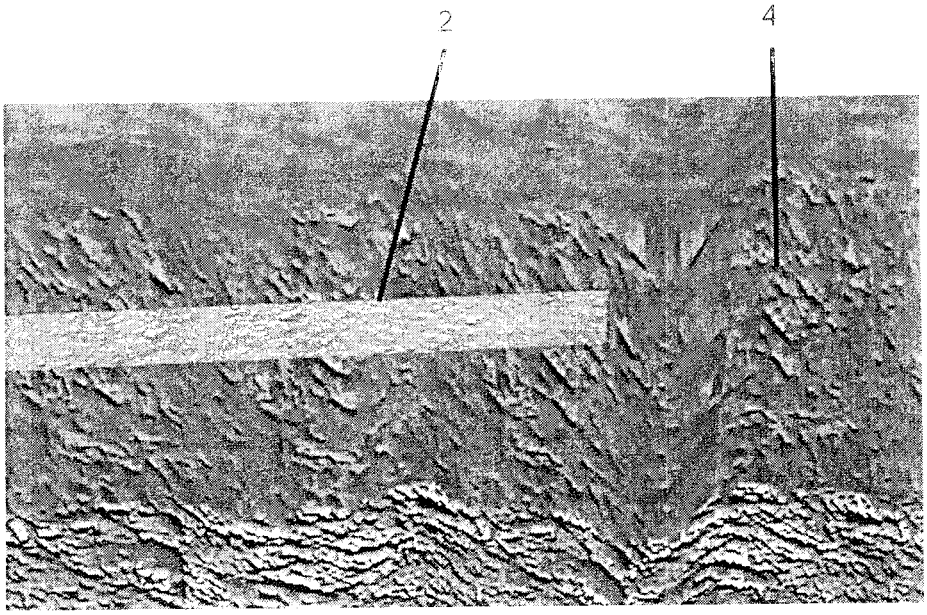
FIG. 2 is a diagram showing an open wellbore before intermediate casing is inserted.
Figure 3:
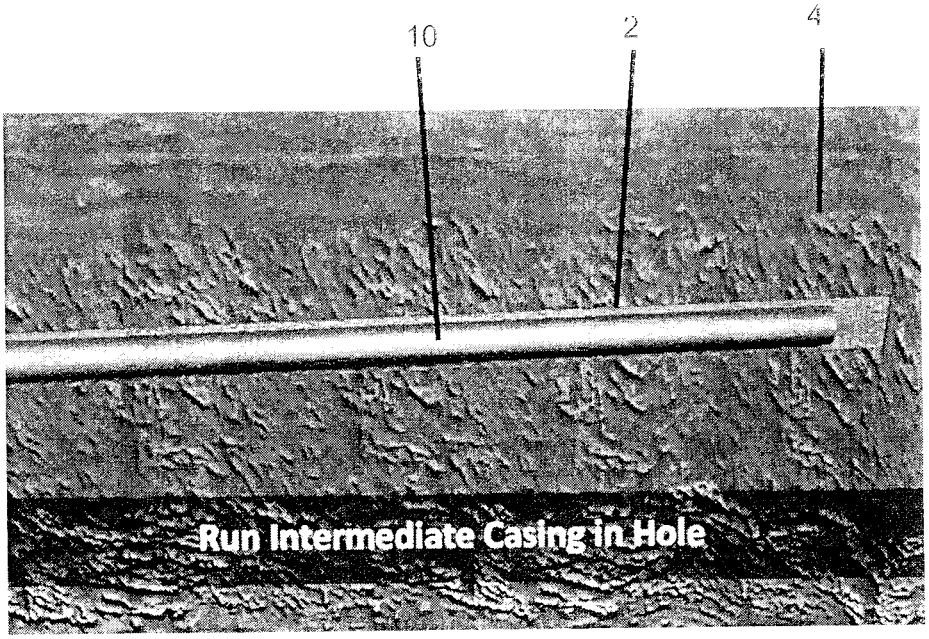
FIG. 3 is a diagram showing the insertion of intermediate casing into the wellbore.
Figure 4:
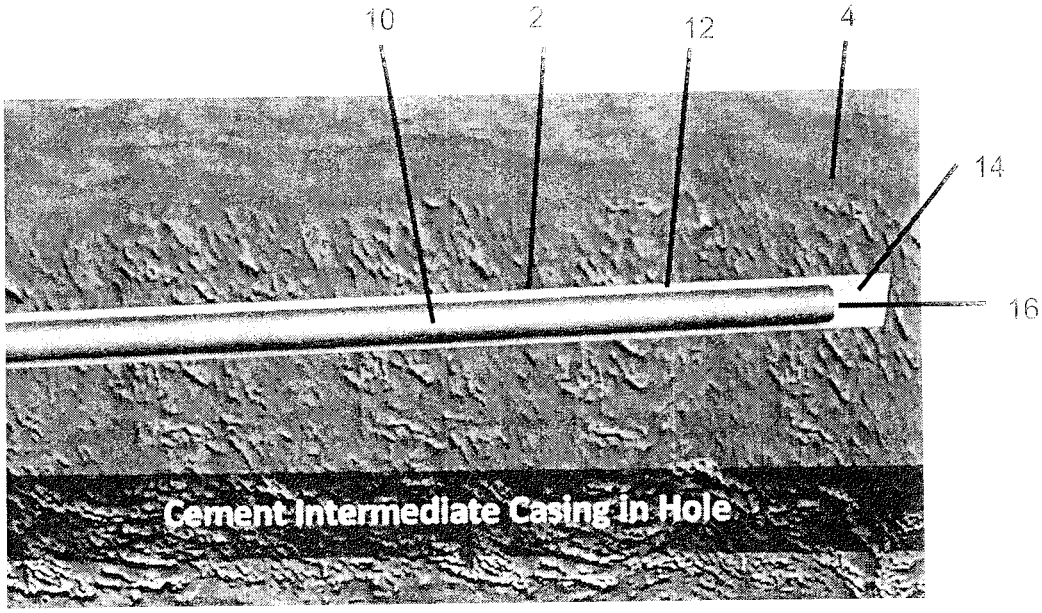
FIG. 4 is a diagram showing the cementing of the intermediate casing in the wellbore.
Figure 5:
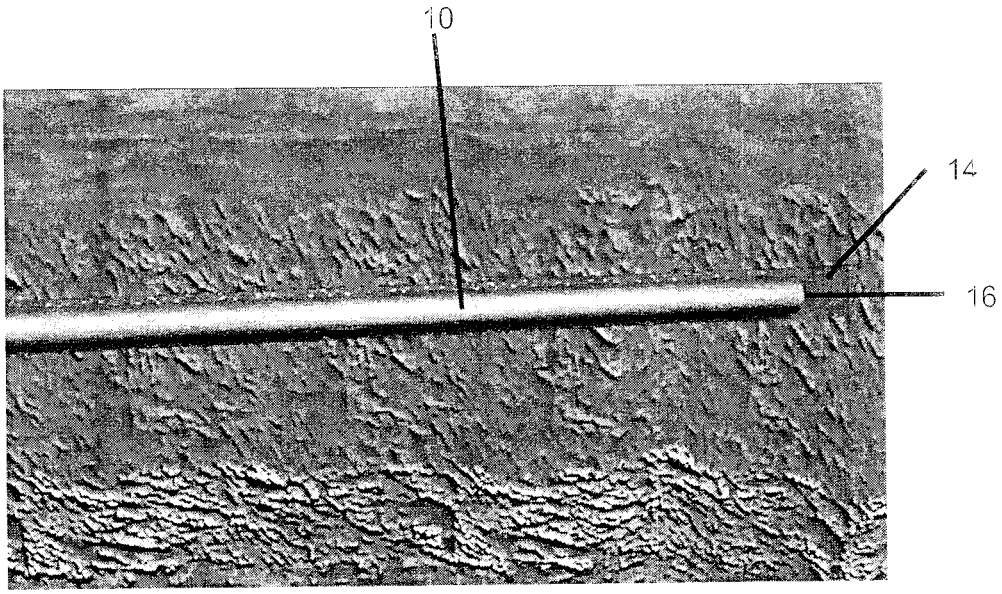
FIG. 5 is a diagram showing the intermediate casing cemented in the wellbore.

In an exemplary embodiment, with reference to FIG. 1, an intermediate wellbore 2 is drilled in a subterranean formation 4 using a conventional drill string 6 with a conventional drill bit 8 attached to the end thereof. The drill string 6 is then withdrawn from the intermediate wellbore 2 (see FIG. 2) and an intermediate casing 10 is run into the wellbore 2 (see FIG. 3). The space between the outside of casing 10 and the wellbore 2 is called the annulus 12. With reference to FIG. 4, suitable cement 14 is pumped into the casing 10 under high pressure where it exits the end of the casing 10 (known as the shoe 16) and fills in the annulus 12. In this respect, casing 10 is generally cemented into place, such that the cement 14 generally fills the space both inside at least an end section (shoe joint) of casing 10 as well as the annulus 12. FIG. 5 shows the casing 10 wherein the cement 14 is hardened in place such that the shoe 16 is closed off. A person skilled in the art to which the invention relates will understand, however, that the use of the casing 10 in the manner described above is optional as methods according to the present invention can also be applied to "mono-bore" wellbore configurations.

Figure 6:
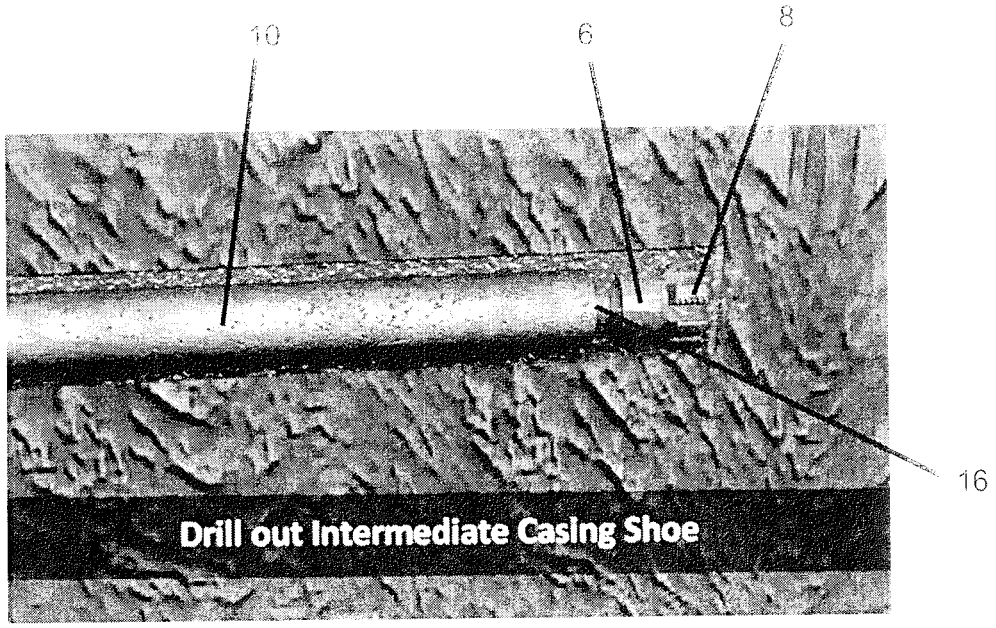
FIG. 6 is a diagram showing the drilling out of the shoe in the intermediate casing.
Figure 7:
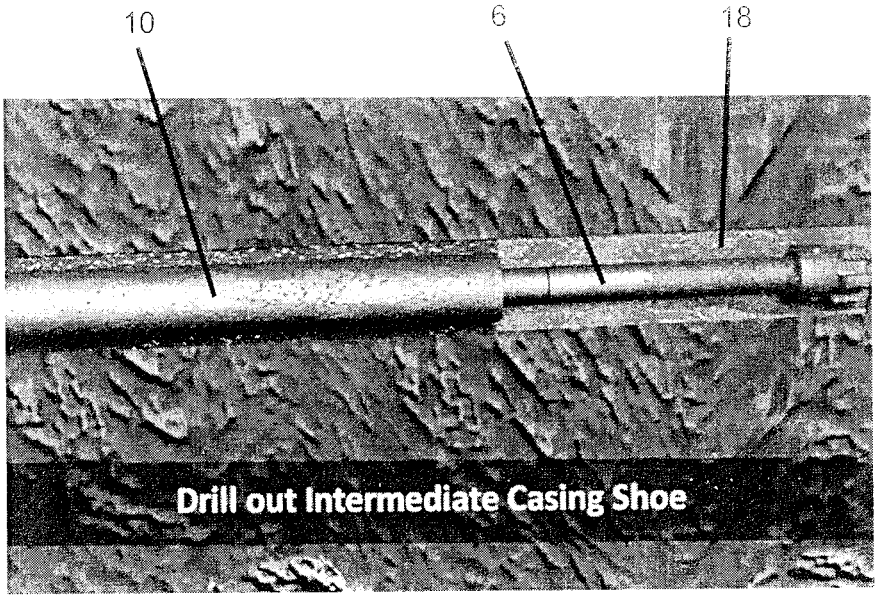
FIG. 7 is a diagram showing the drilling of a first section beyond the intermediate casing.
Figure 8:
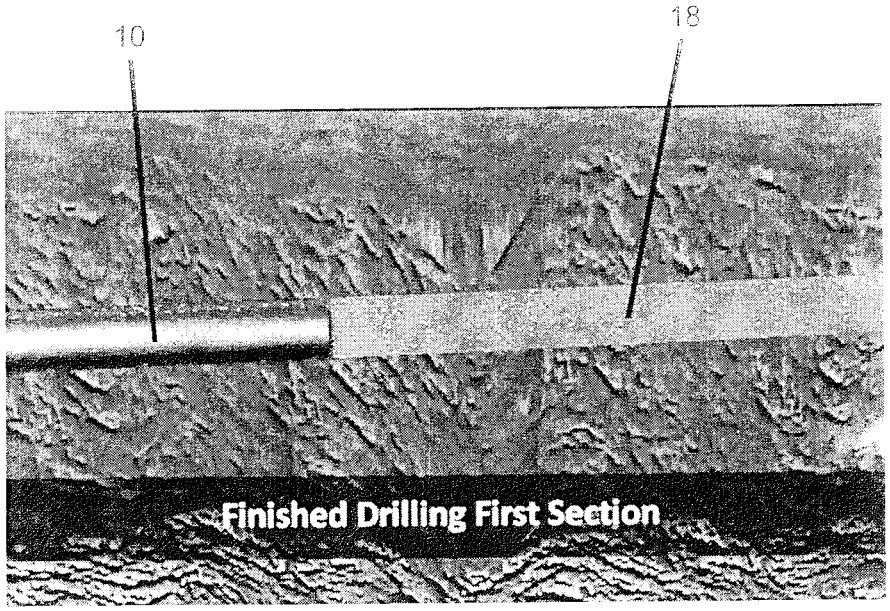
FIG. 8 is a diagram showing the open first section of the wellbore.
Figure 9:
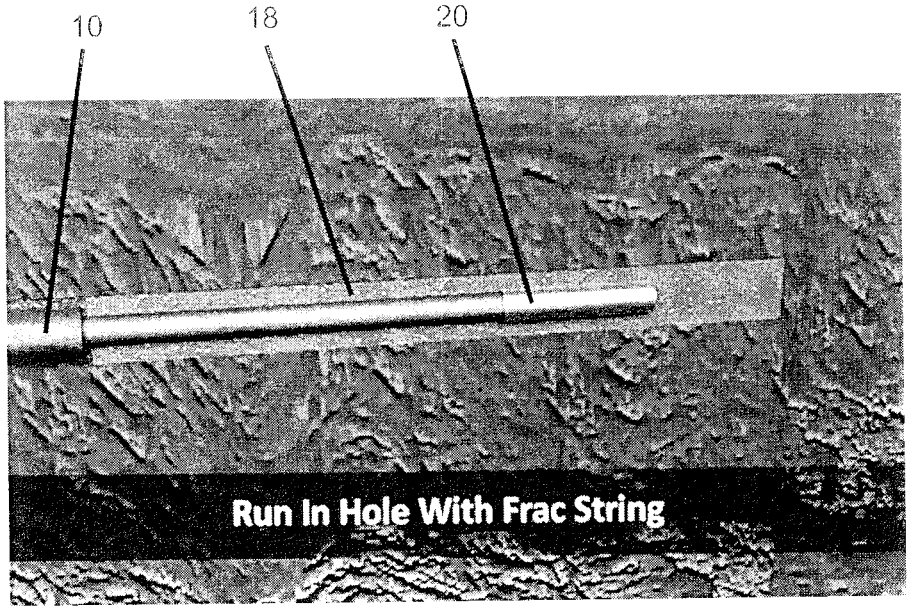
FIG. 9 is a diagram showing the insertion of a frac string into the first section of the wellbore.

With reference to FIG. 6, the drill string 6 is then run into the casing 10 and drills out the shoe 16 of the intermediate casing 10. With reference to FIG. 7, the drill string 6 then continues drilling a first section of the wellbore 2 (indicated generally at 18) extending from and beyond the intermediate wellbore 2. The drill string 6 is then withdrawn (see FIG. 8) and a frac string 20 is run into the first section 18 (see FIG. 9).

Figure 10:
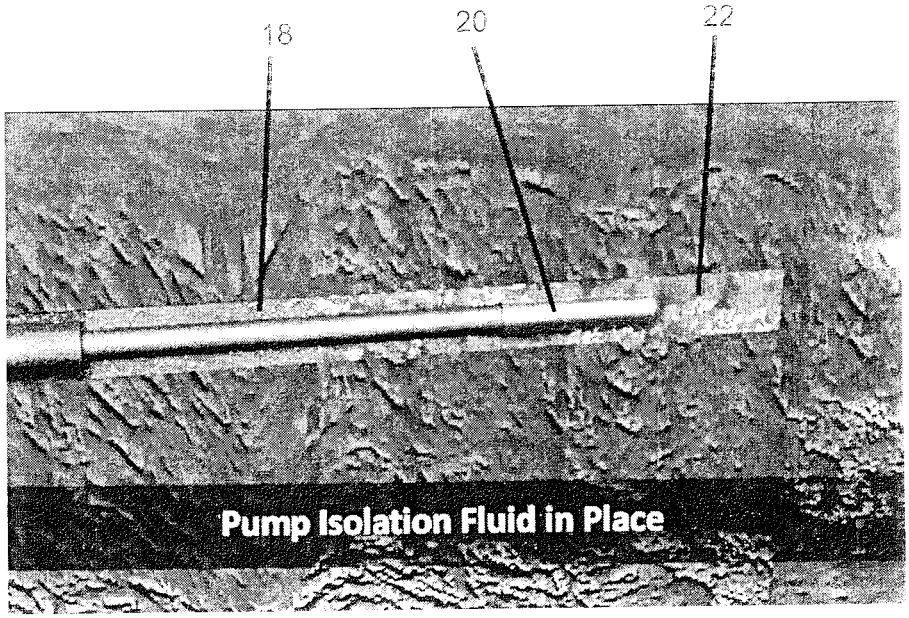
FIG. 10 is a diagram showing the pumping of isolation fluid from the frac string into the first section of the wellbore.

With reference to FIG. 10, an isolation fluid 22 is introduced into the first section 18 through openings in the frac string 20 to fill all or part of the first section 18. The isolation fluid 22 is one which can withstand the pressure created at the fracture (called fracture initiation pressure) and that therefore does not allow significant movement of a fracturing fluid to another part of the well. The isolation fluid 22 can be a suitable gel, for example.

Figure 11:
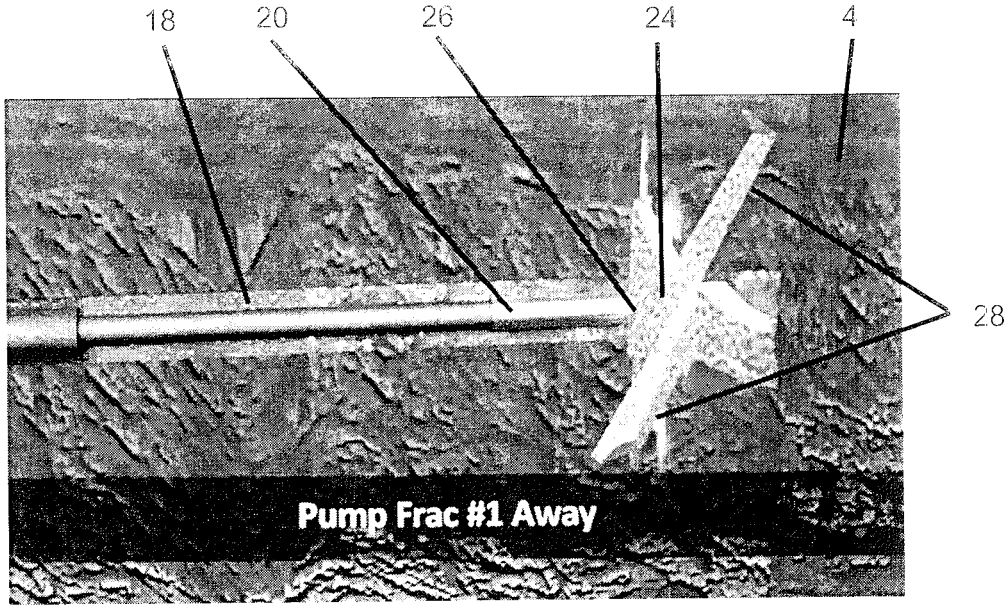
FIG. 11 is a diagram showing the pumping of frac fluid from the frac string into the first section of the wellbore.
Figure 12:
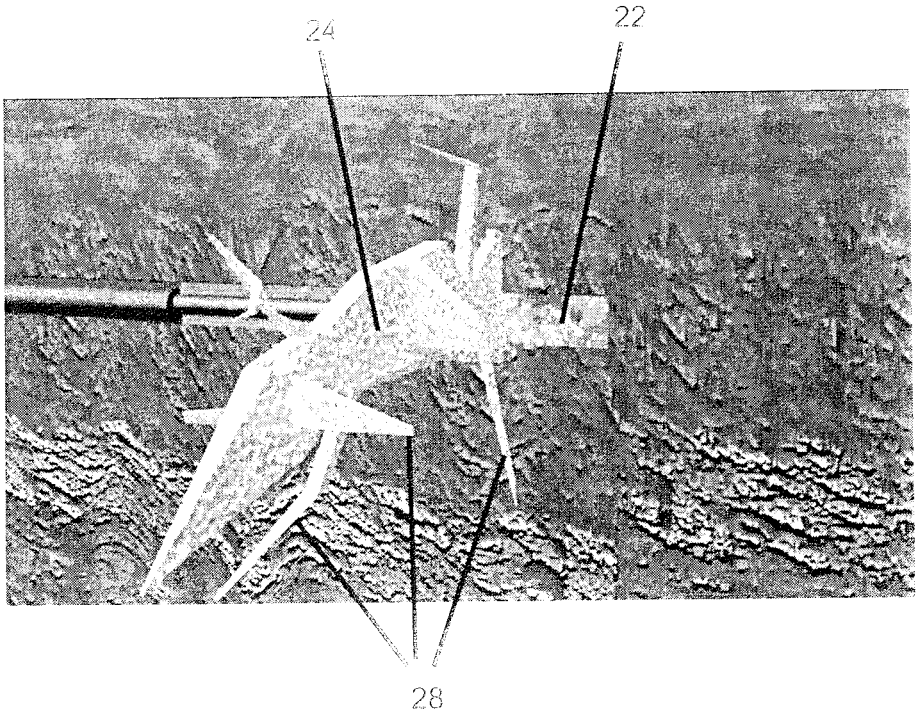
FIG. 12 is a diagram showing fractures created in the subterranean formation from the frac treatment to the first section of the wellbore.

With reference to FIG. 11, a fracturing fluid 24 is then pumped into the first section 18 through an opening 26 in the frac string 20 at a pressure sufficient to create fractures 28 (i.e. sufficient enough to exceed the fracture gradient of the rock) in the subterranean formation 4 in the vicinity of the end of the frac string 20 and the end of the first section 18. The fracturing fluid 24 is often a slurry of, for example, mainly water, and some sand and additives, but can include any suitable fluid including but not limited to water, salt water, hydrocarbon, acid, methanol, carbon dioxide, nitrogen, foam, emulsions, etc. Such fracturing fluids are well known to persons skilled in the art. FIG. 12 shows a different perspective view of the fractures 28 (tree-like dendritic fairways) propogating throughout the formation 4 in the vicinity of the end of the frac string 20.

Figure 13:
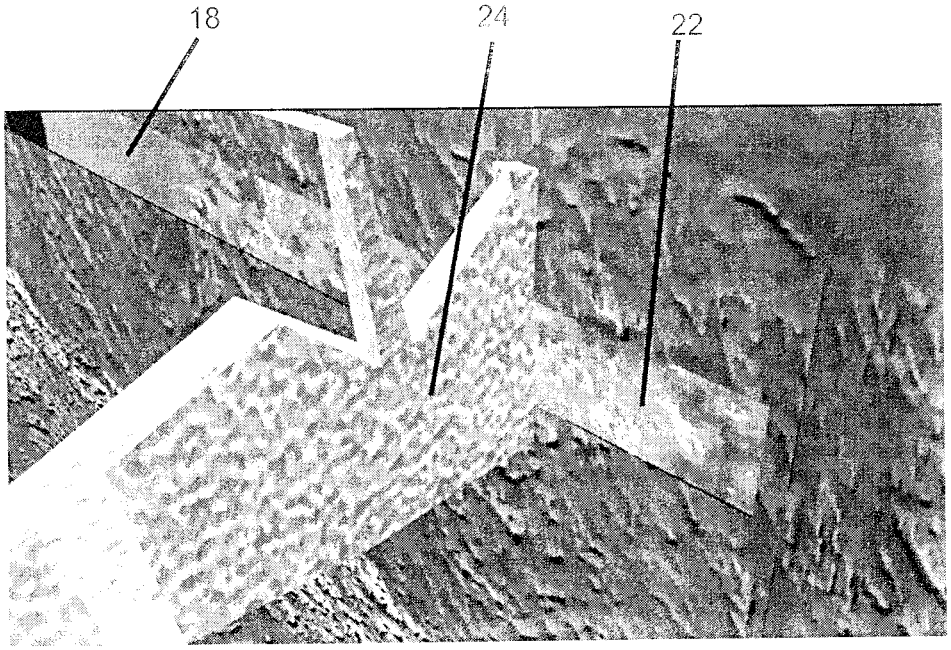
FIG. 13 is a diagram showing the removal of the frac string from the wellbore.
Figure 14:
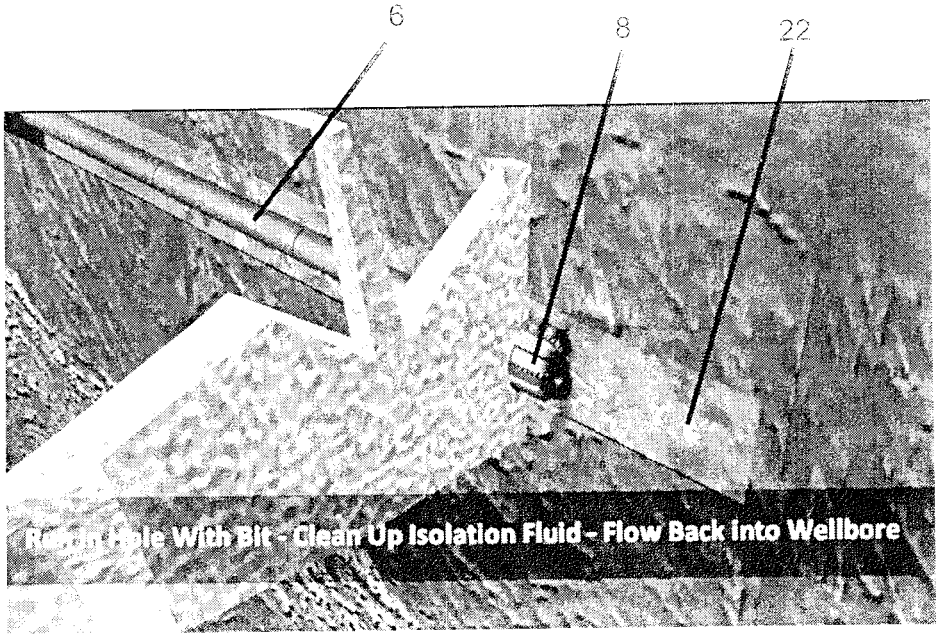
FIG. 14 is a diagram showing the insertion of the drill string through the isolation fluid in the first section of the wellbore.
Figure 15:
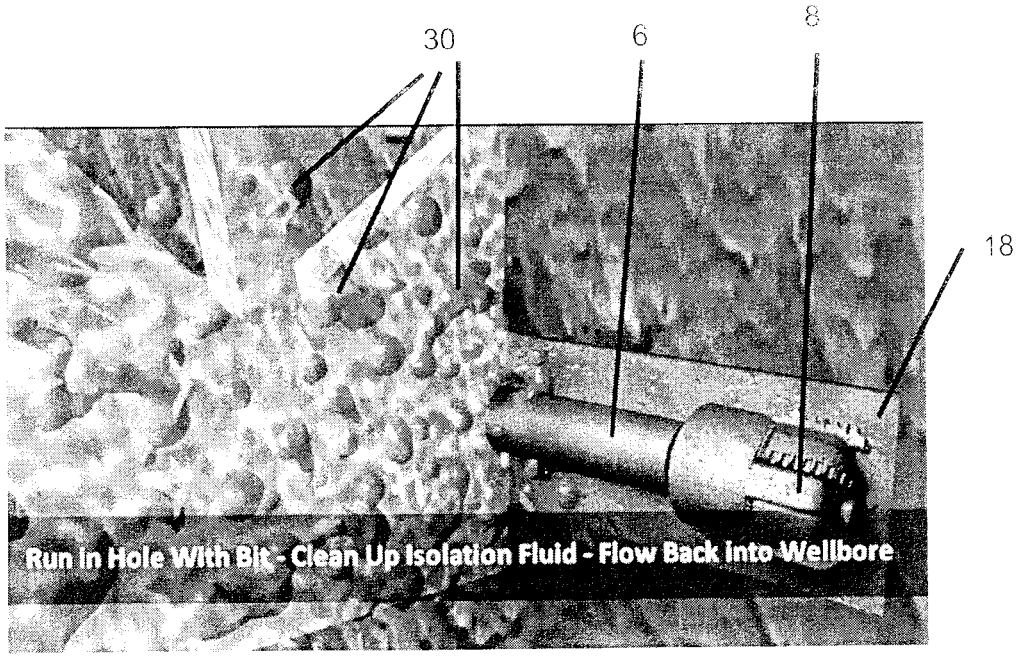
FIG. 15 is a diagram showing the flow of hydrocarbons or gas from the fractures into the first section of the wellbore.
Figure 16:
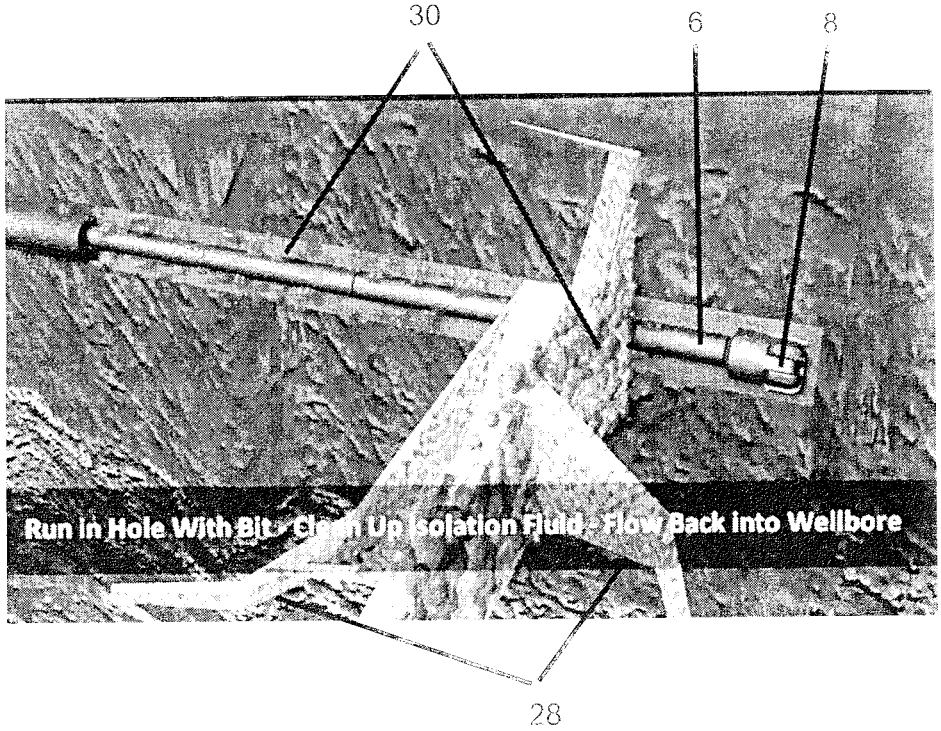
FIG. 16 is a diagram showing the drill string extending to the end of the first section of the wellbore.
Figure 17:
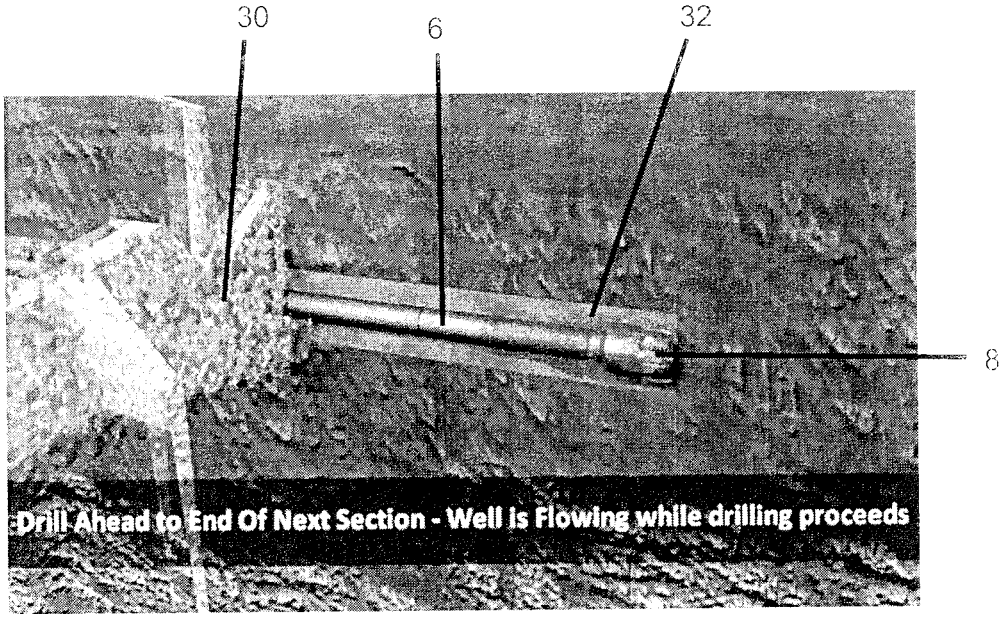
FIG. 17 is a diagram showing the drilling ahead of a section of the wellbore.

With reference to FIG. 13, the frac string 20 is then withdrawn and the drill string 6 is run to the end of the first section 18 through the isolation fluid 22 (see FIG. 14). The isolation fluid 22 is then "cleaned up" by rotating the bit 8 through and flowing it back out of the well through the annulus between the drill string 6 and the open hole and between the drill string and the intermediate casing 10, along with drilled material being circulated to the surface (not shown) and production (hydrocarbons or gas 30) from the newly formed fractures 28 (see FIGS. 15 and 16). The drill string 6 is then moved ahead to the end of the first section 18, and a second section (indicated generally at 32) is drilled to extend the wellbore 2 (see FIG. 17). In so doing, an operator can then perform multi-stage fracking while the wellbore is being drilled/extended by repeating the isolation and fracturing steps described above. It is important to note that at this time, hydrocarbons or gas 30 are flowing into the well, and are therefore recoverable at this stage, even while drilling proceeds. As a result, the well operator is able to determine in real time if the recent fracture treatment has been successful at this early stage, including determining the sufficiency of the fracture treatment composition, and whether the fracture treatment is having a net positive or negative effect on flow of the hydrocarbons or gas 30. Based on the composition of the inflow up the well, an operator may determine, for instance, that a given frac treatment has been effective or may determine that a different fracturing fluid/slurry should be employed for subsequent frac treatments based on the rock formation encountered. This is to be distinguished from conventional fracking techniques where there is no real time feedback, no way to know whether the fracturing fluid/slurry used was effective, and no way for an operator to know what must be done to improve performance.

Figure 18:
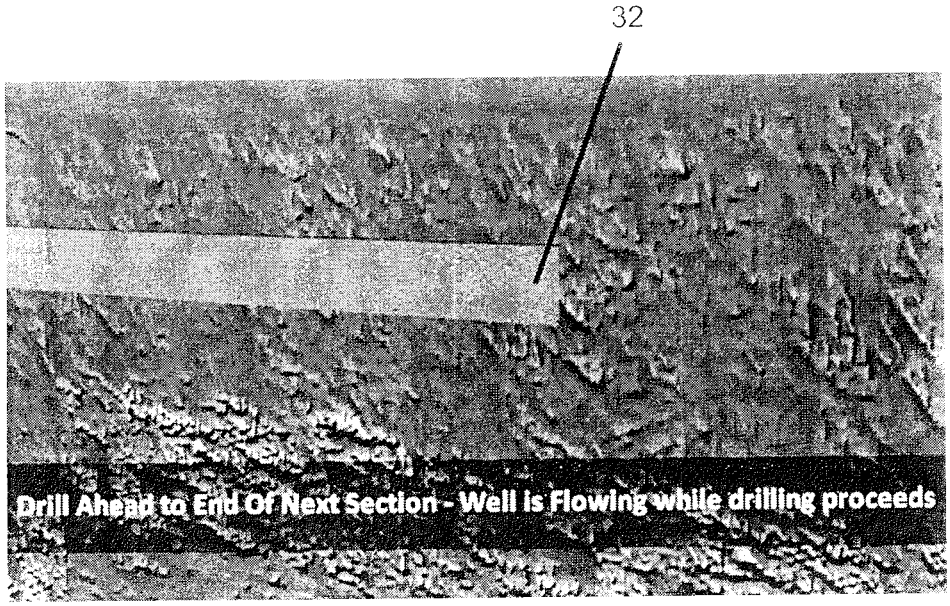
FIG. 18 is a diagram showing the open second section of the wellbore before the frac string is inserted.
Figure 19:
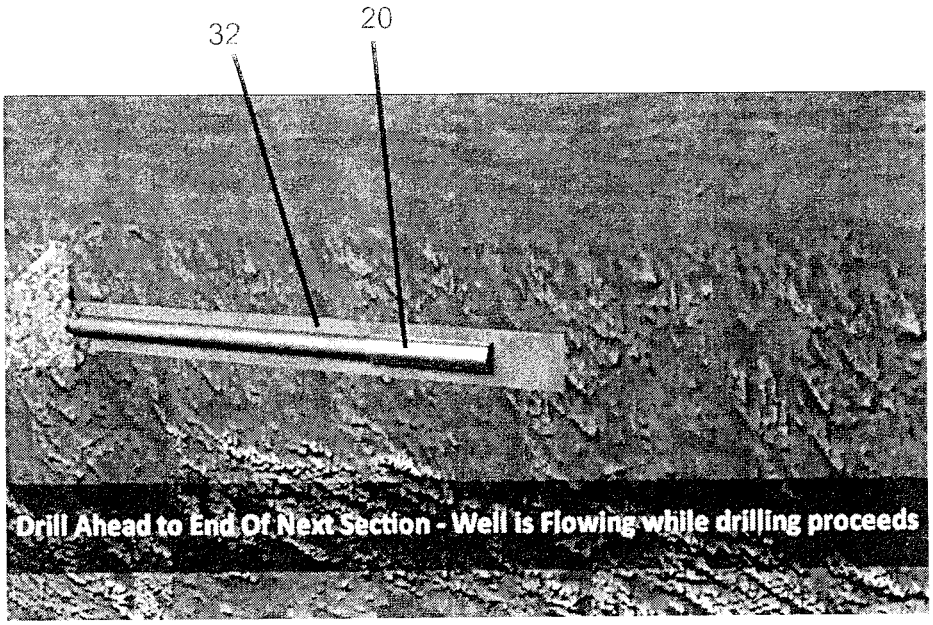
FIG. 19 is a diagram showing the insertion of a frac string into the second section of the wellbore.
Figure 20:
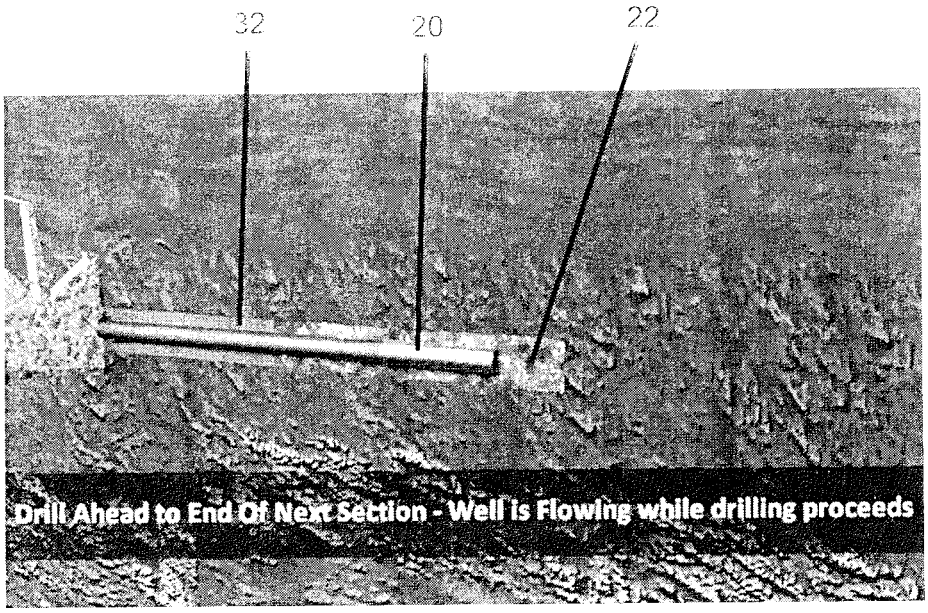
FIG. 20 is a diagram showing the pumping of isolation fluid from the frac string into the second section of the wellbore.
Figure 21:
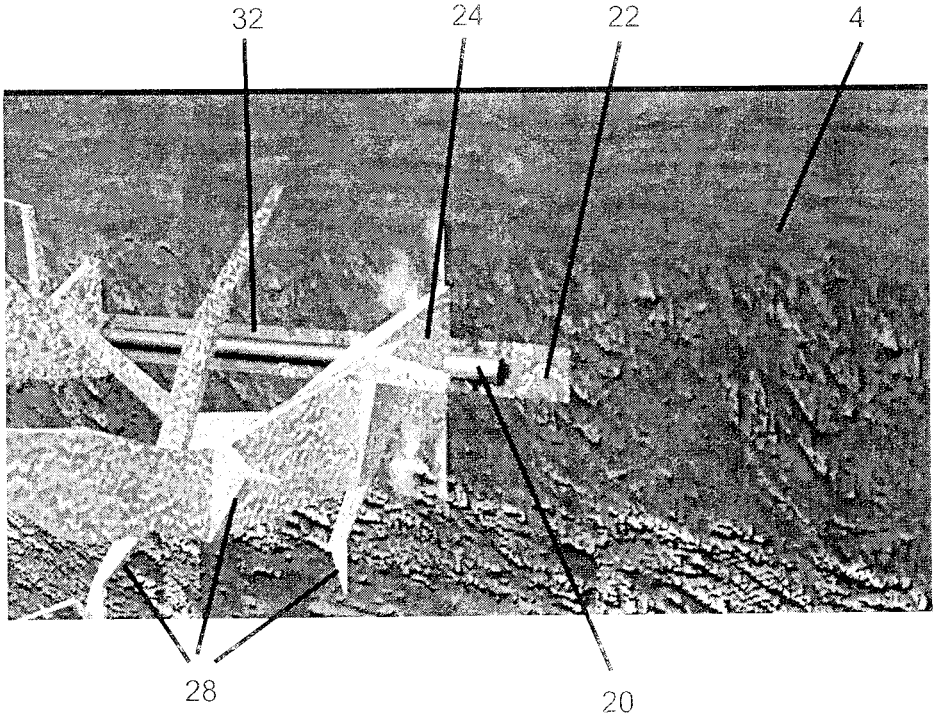
FIG. 21 is a diagram showing the pumping of frac fluid from the frac string into the second section of the wellbore to create fractures in the subterranean formation.
Figure 22:
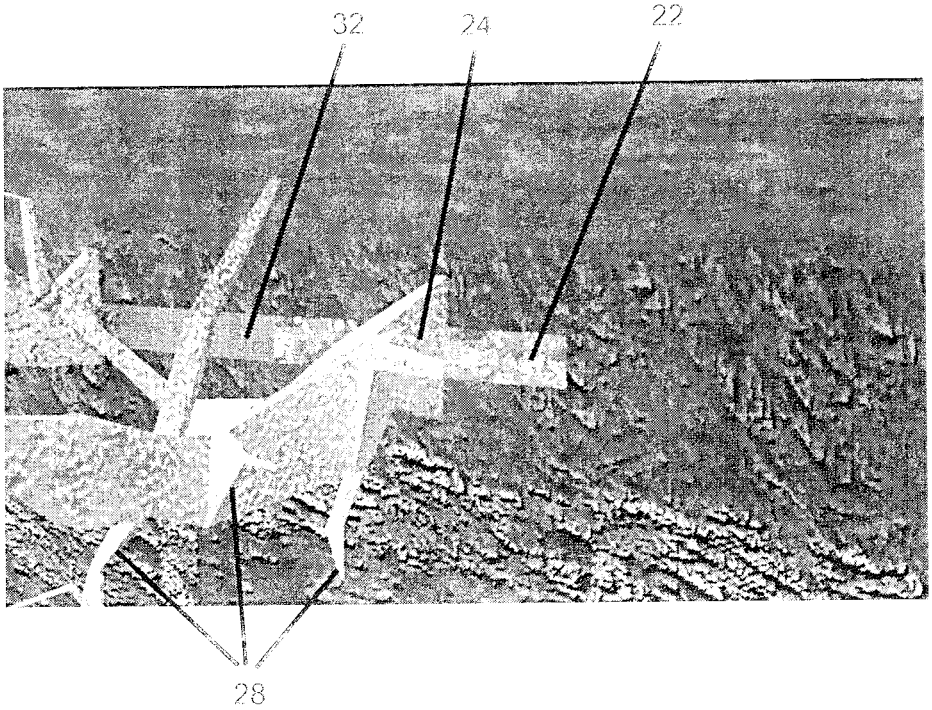
FIG. 22 is a diagram showing the removal of the frac string from the wellbore.
Figure 23:
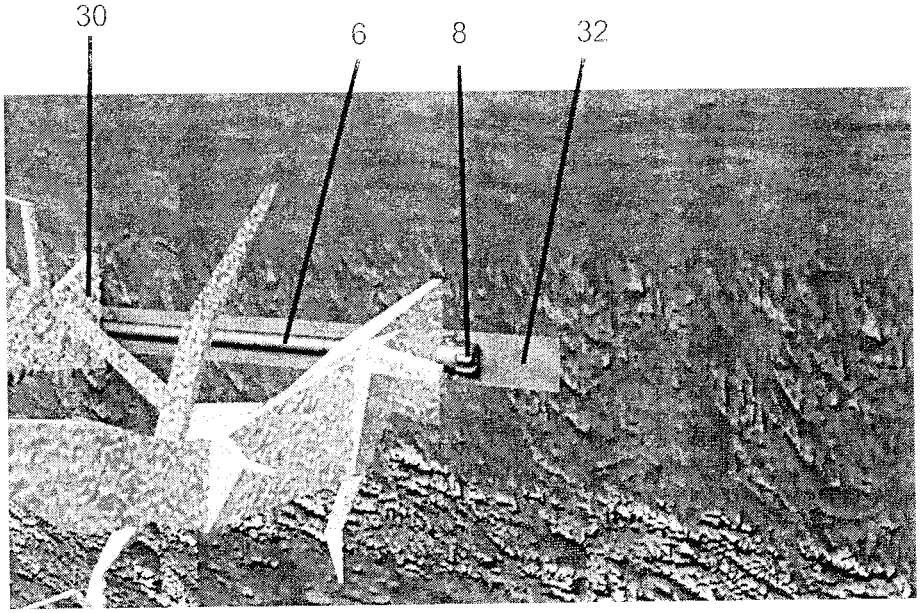
FIG. 23 is a diagram showing the insertion of the drill string through the isolation fluid in the second section of the wellbore.
Figure 24:
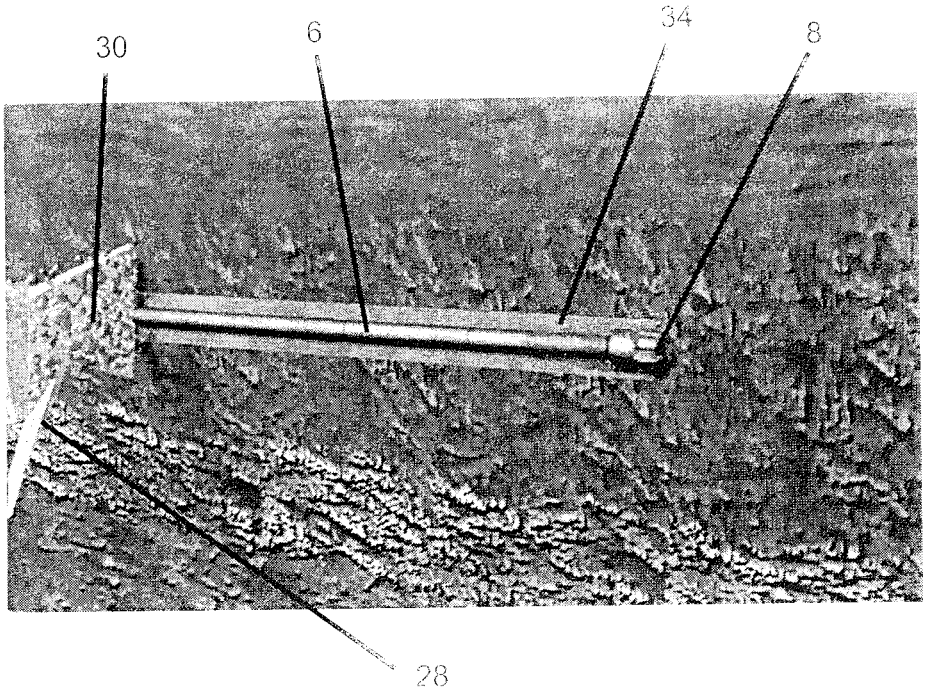
FIG. 24 is a diagram showing the drilling ahead of a third section of the wellbore.

The repeated isolation and multi-stage fracturing steps are shown in FIGS. 18 to 32. In particular, with reference to FIG. 18, the drill string 6 is withdrawn from the wellbore (see FIG. 18) and a frac string 20 is run into the second section 32 (see FIG. 19). With reference to FIG. 20, an isolation fluid 22 is introduced into the second section 32 through openings in the frac string 20 to fill all or part of the second section 32. With reference to FIG. 21, a fracturing fluid 24 is then pumped into the second section 32 through an opening in the frac string 20 at a pressure sufficient to create fractures 28 in the subterranean formation 4 in the vicinity of the end of the frac string 20 and near the end of the second section 32. With reference to FIG. 22, the frac string 20 is then withdrawn and, with reference to FIG. 23, the drill string 6 is run to the end of the second section 32 through the isolation fluid 22 (not shown). The isolation fluid 22 is "cleaned up" by rotating the bit 8 through and flowing it back out of the well through the annulus between the drill string 6 and the open hole and between the drill string and the intermediate casing 10, along with drilled material being circulated to the surface (not shown) and production (hydrocarbons or gas 30) from the newly formed fractures 28. In particular, with reference to FIG. 24 (which shows the drilling/extension of a third section 34 of the wellbore 2), because hydrocarbons or gas 30 are now flowing into the well from fractures 28 from both the first section 18 and the second section 32, as noted above, the well operator is able to determine in real time if the second fracture treatment has been successful at this early stage, including whether the fracture treatment composition should be changed, and whether such treatment is having a net positive or negative effect on overall flow of the hydrocarbons or gas 30 into the well. Based on the composition of the inflow up the well, the operator may determine, for instance, that the given frac treatment has been effective or may determine that a different fracturing fluid/slurry should be employed for subsequent frac treatments based on the rock formation encountered. Once again, this is to be distinguished from conventional fracking techniques where there is no real time feedback, no way to know whether a proper fracturing slurry was used at a particular stage/site, and no way for an operator to know what must be done to improve performance.

Figure 25:
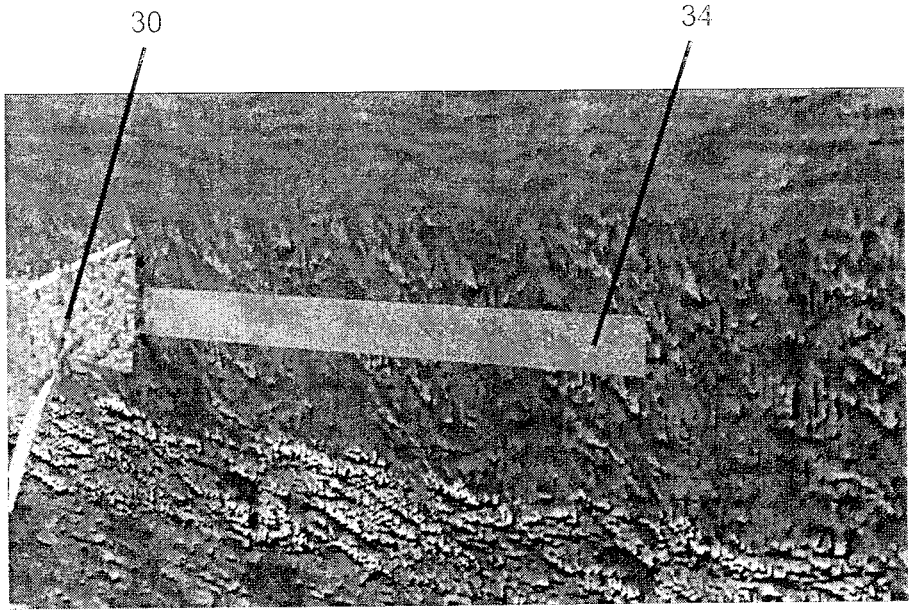
FIG. 25 is a diagram showing the open third section of the wellbore before the frac string is inserted.
Figure 26:
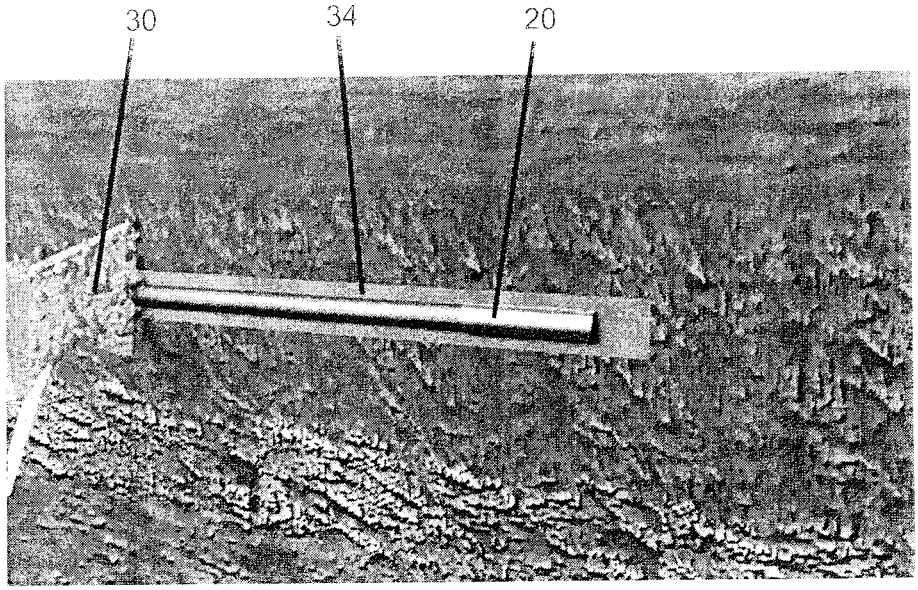
FIG. 26 is a diagram showing the insertion of a frac string into the third section of the wellbore.
Figure 27:
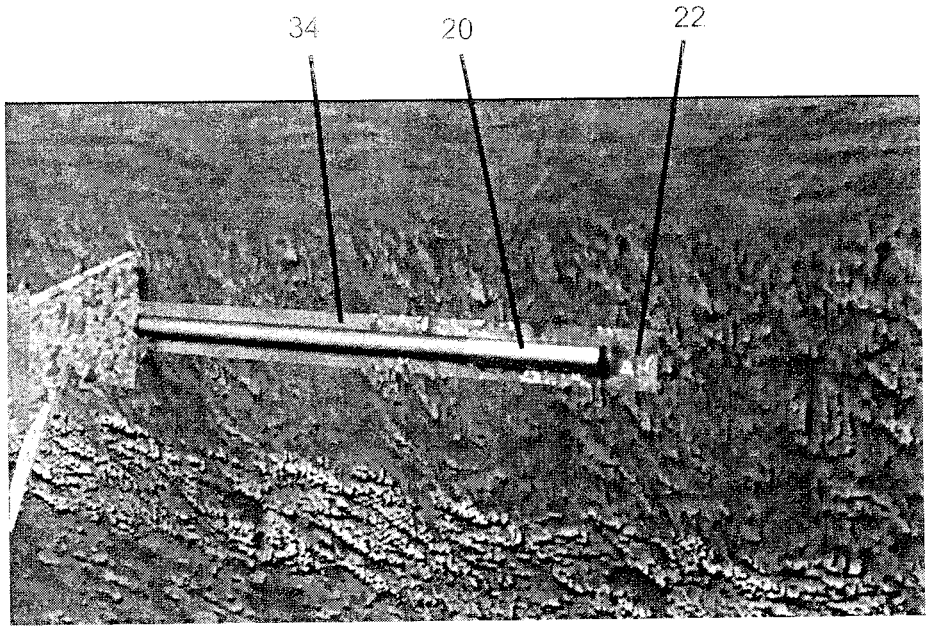
FIG. 27 is a diagram showing the pumping of isolation fluid from the frac string into the third section of the wellbore.
Figure 28:
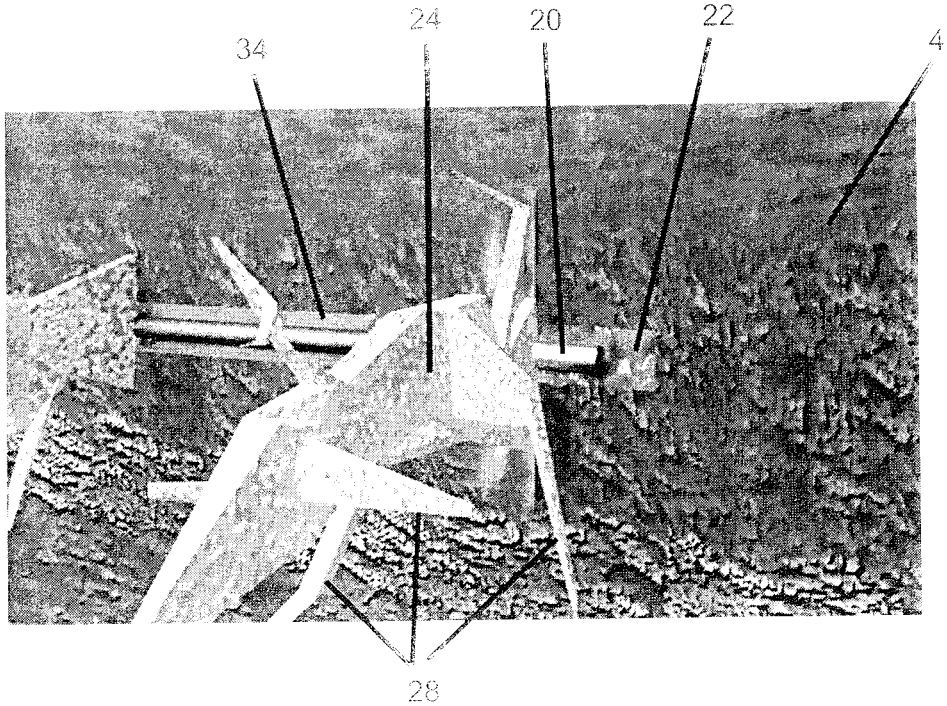
FIG. 28 is a diagram showing the pumping of frac fluid from the frac string into the third section of the wellbore to create fractures in the subterranean formation.
Figure 29:
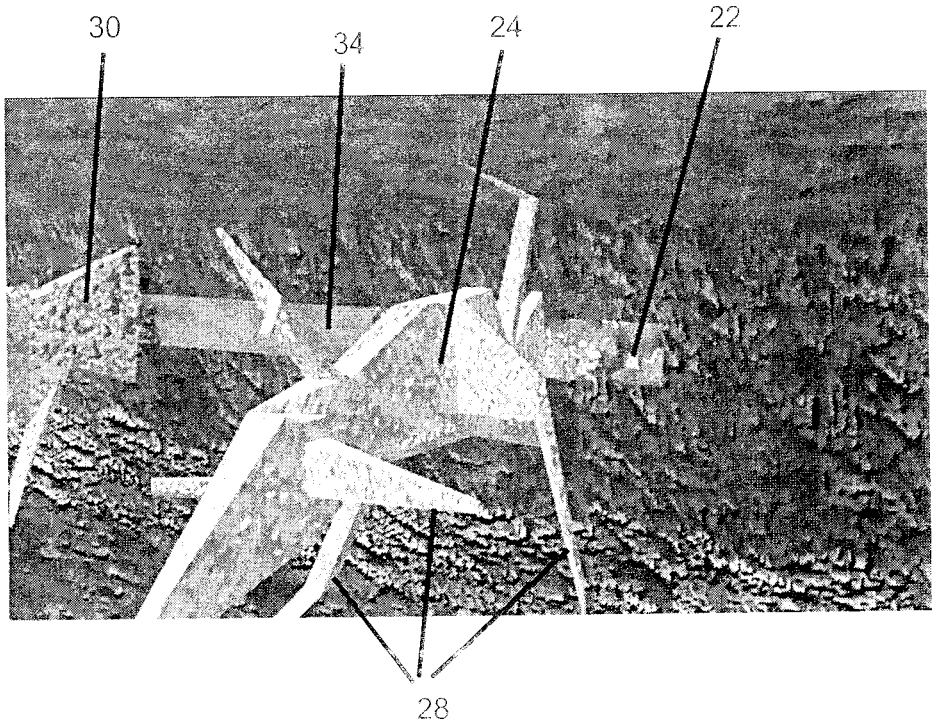
FIG. 29 is a diagram showing the removal of the frac string from the wellbore.
Figure 30:
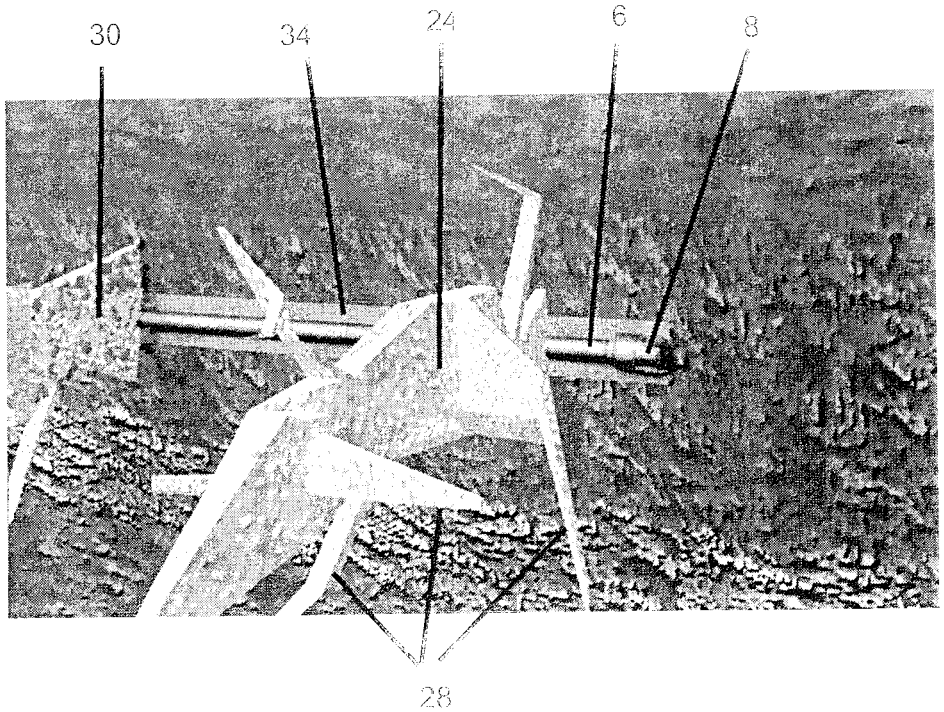
FIG. 30 is a diagram showing the insertion of the drill string through the isolation fluid in the third section of the wellbore.
Figure 31:
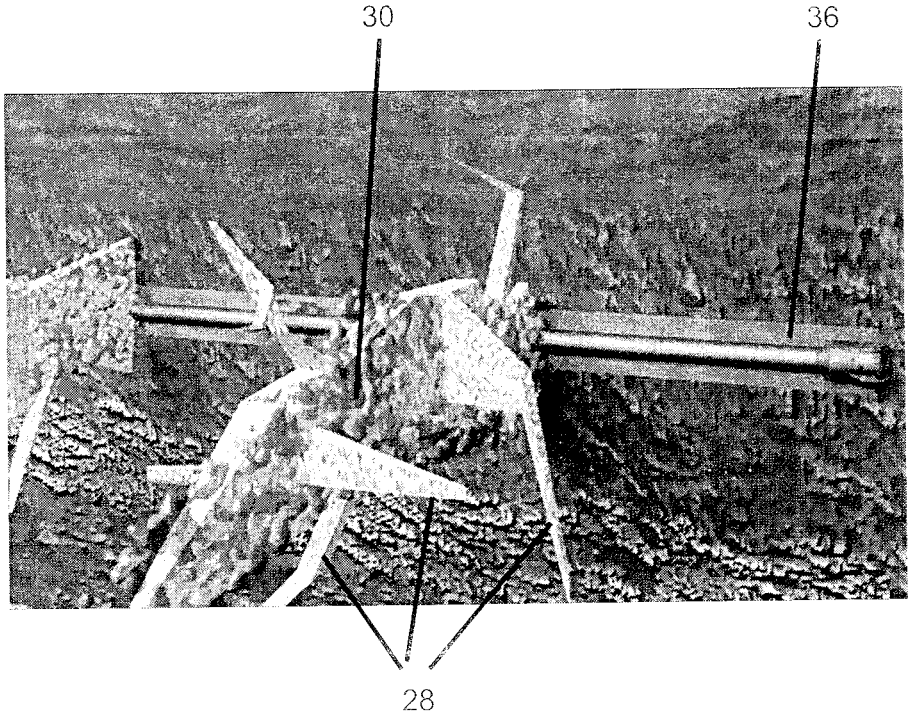
FIG. 31 is a diagram showing the drilling ahead of a fourth section of the wellbore while hydrocarbons or gas are flowing into the wellbore.
Figure 32:
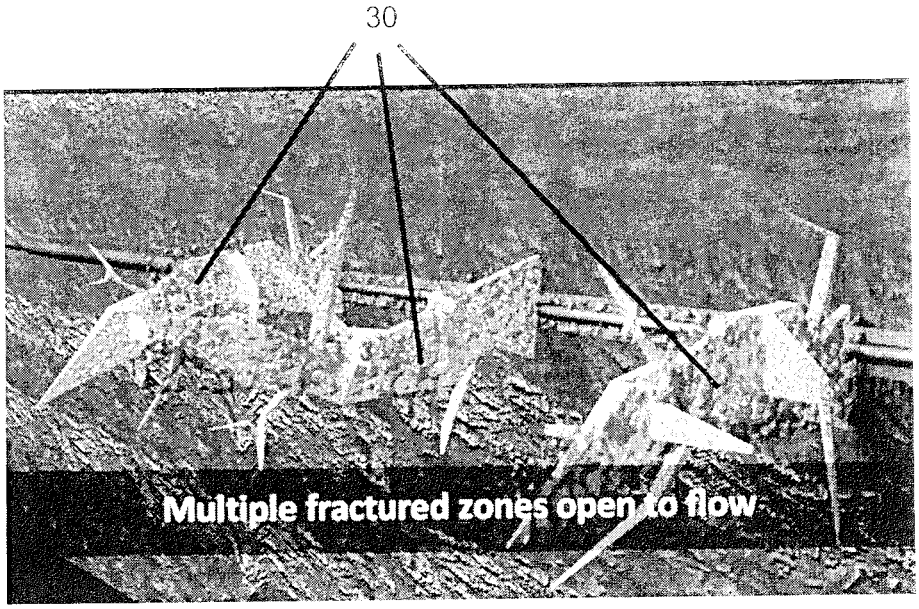
FIG. 32 is a diagram showing the flowing of hydrocarbons or gas from fractures in the first, second, and third sections into the wellbore.

The repeated process then continues at FIG. 25. The drill string 6 is withdrawn and a frac string 20 is run into the third section 34 (see FIG. 26). With reference to FIG. 27, an isolation fluid 22 is introduced into the third section 34 through openings in the frac string 20 to fill all or part of the third section 34. With reference to FIG. 28, a fracturing fluid 24 is then pumped into the third section 34 through an opening in the frac string 20 at a pressure sufficient to create fractures 28 in the subterranean formation 4 in the vicinity of the end of the frac string 20 and near the end of the third section 34. With reference to FIG. 29, the frac string 20 is then withdrawn and, with reference to FIG. 30, the drill string 6 is run to the end of the third section 34 through the isolation fluid 22 (not shown). The isolation fluid 22 is "cleaned up" by rotating the bit 8 through and flowing it back out of the well through the annulus between the drill string 6 and the open hole and between the drill string and the intermediate casing 10, along with drilled material being circulated to the surface (not shown) and production (hydrocarbons or gas 30) from the newly formed fractures 28. In particular, with reference to FIG. 31 (which shows the drilling/extension of a fourth section 36 of the wellbore 2), because hydrocarbons or gas 30 are now flowing into the well from fractures 28 from both the first section 18, the second section 32, and the third section 34 (see FIG. 32), the well operator can determine in real time if the third fracture treatment has been successful at this early stage, including whether the fracture treatment composition should be changed, and whether such change is having a net positive or negative effect on overall flow of hydrocarbons or gas 30 into the well. Based on the composition of the inflow up the well, the operator may determine, for instance, that the given frac treatment has been effective or may determine that a different fracturing fluid/slurry should be employed for subsequent frac treatments based on the rock formation encountered. Once again, this is to be distinguished from conventional fracking techniques where there is no real time feedback, no way to know whether a proper fracturing slurry was used at a particular stage/site, and no way for an operator to know what must be done to improve performance. A person skilled in the art would understand that such a process could continue further throughout the entire desired length of the wellbore.

In another exemplary embodiment (not shown), the process may proceed as shown in FIGS. 1 to 5, however, at this stage a hybrid drill/frac string with a drill BHA on the end (not shown) is then run into the casing 10, the shoe 16 is drilled out, and a first section 18 extending from and beyond the intermediate wellbore 2 is drilled (as in FIG. 7). The drill BHA part would then be disconnected from the hybrid drill/frac string and withdrawn back up to the surface through the string using a wireline or similar arrangement. An isolation fluid 22 is then introduced into the first section 18 through the hybrid drill/frac string to fill all or part of the first section 18. The isolation fluid 22 is one which can, as stated previously, withstand the pressure created at the fracture (called fracture initiation pressure) and that therefore does not allow significant movement of a fracturing fluid to another part of the well. The isolation fluid 22 can be a suitable gel for example. A fracturing fluid 24 is then introduced through the hybrid drill/frac string into the first section 18 at a pressure sufficient to fracture the subterranean formation 4 in the vicinity of the end of the string, in a manner similar to that shown in FIG. 11. The fracturing fluid can, once again, be a slurry of, for example, mainly water, and some sand and additives, but can include any suitable fluid including but not limited to water, salt water, hydrocarbon, acid, methanol, carbon dioxide, nitrogen, foam, emulsions, etc. The isolation fluid is cleaned up by flowing it back out of well through the hybrid drill/frac string annulus. The hybrid drill/frac string is then moved ahead and a second section beyond the first section is drilled to extend the wellbore. The isolation and fracturing steps described above can then be repeated.

Figure 33:
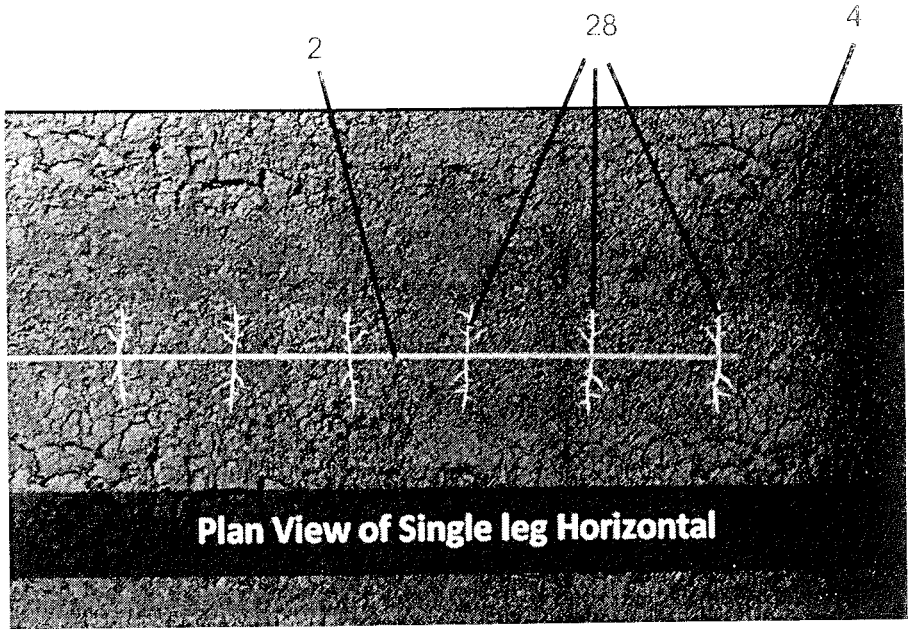
FIG. 33 is a plan view of hypothetical fractures in a single leg horizontal wellbore.
Figure 34:
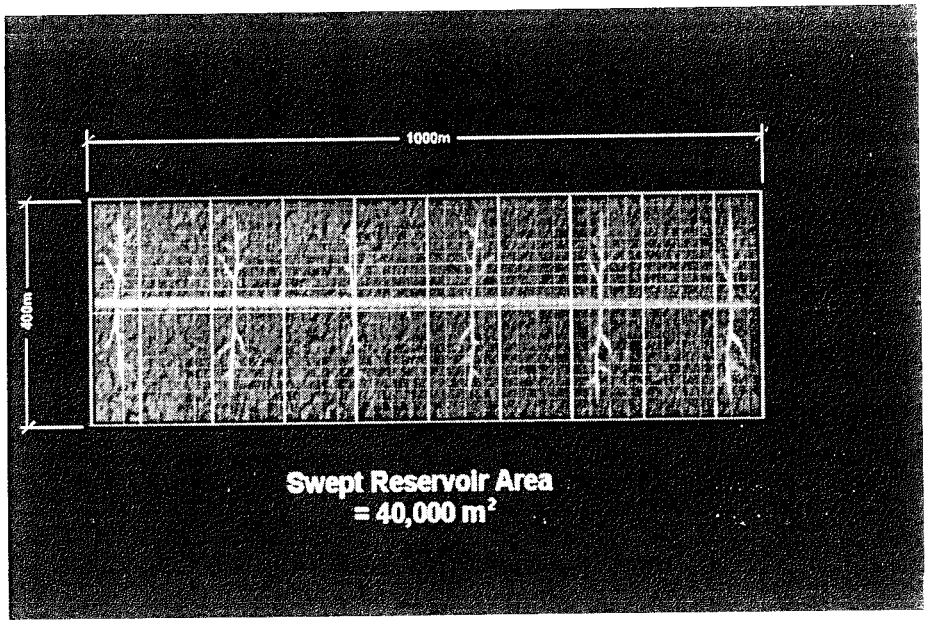
FIG. 34 is a plan view of hypothetical fractures in a single leg horizontal wellbore with an overlay showing the swept reservoir area.

FIG. 33 shows a plan view of a single leg horizontal wellbore 2 with fractures 28 propogated in a subterranean formation 4 in accordance with the methods of the present invention. FIG. 34 shows the plan view of FIG. 33 with a grid overlay showing that a horizontal wellbore 1000 m in length, with fractures extending 200 m both above and below the wellbore, will catch hydrocarbons or gas from a reservoir area of approximately 40,000 $m^2$.

Figure 35:
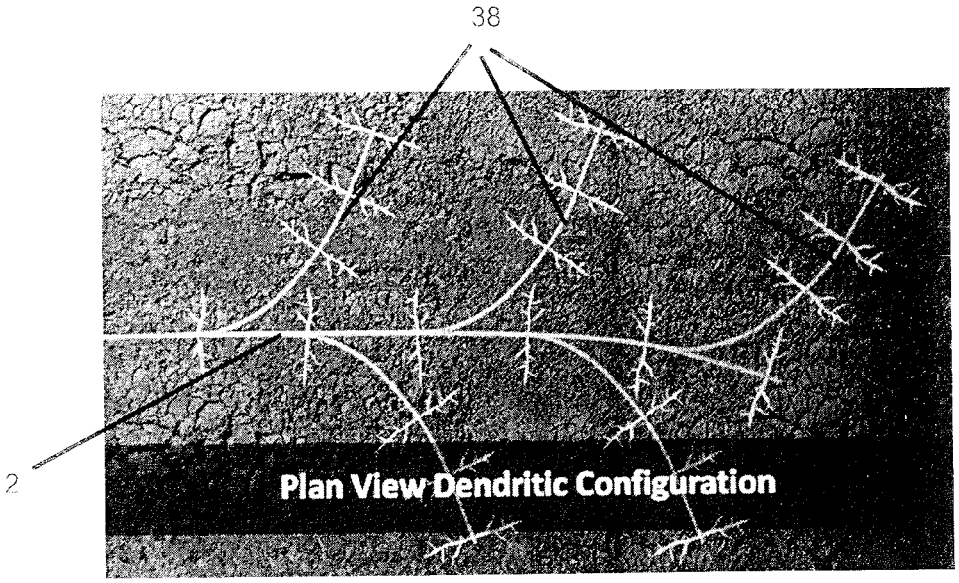
FIG. 35 is a plan view of a hypothetical dendritic wellbore configuration in a subterranean formation.
Figure 36:
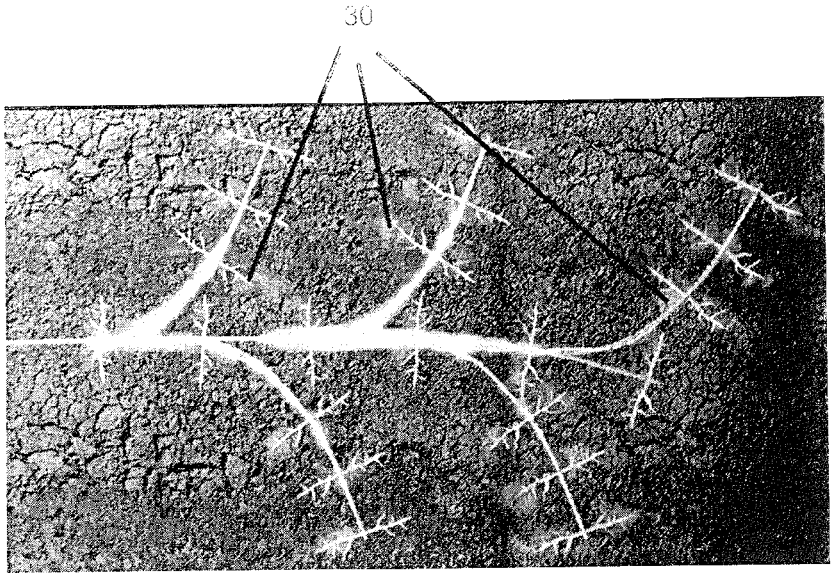
FIG. 36 is a plan view showing production/flow of hydrocarbons or gas from fractures into the dendritic wellbores.
Figure 37:
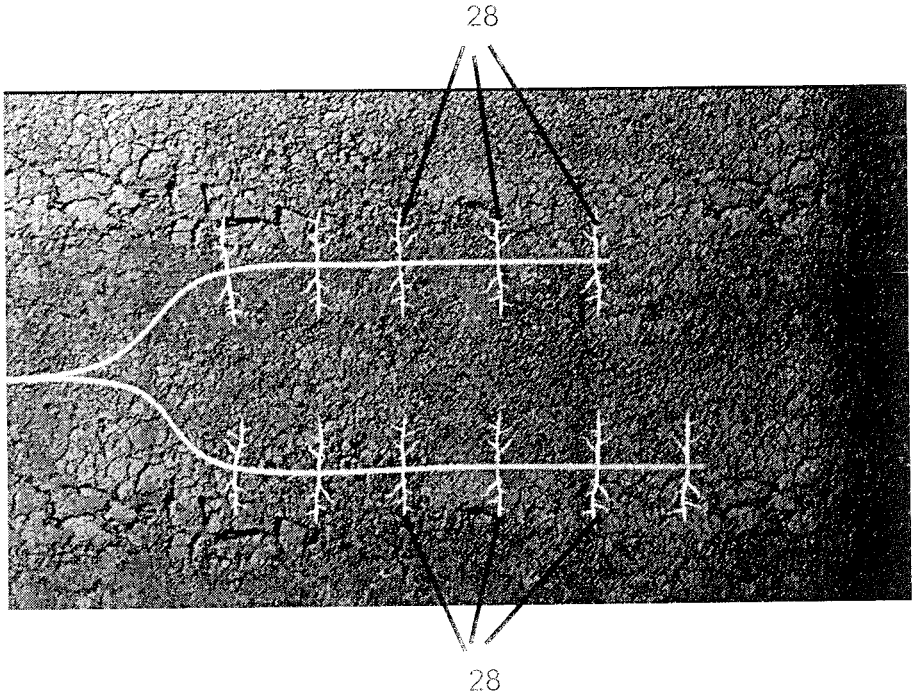
FIG. 37 is a plan view of a hypothetical dual horizontal wellbore configuration.
Figure 38:
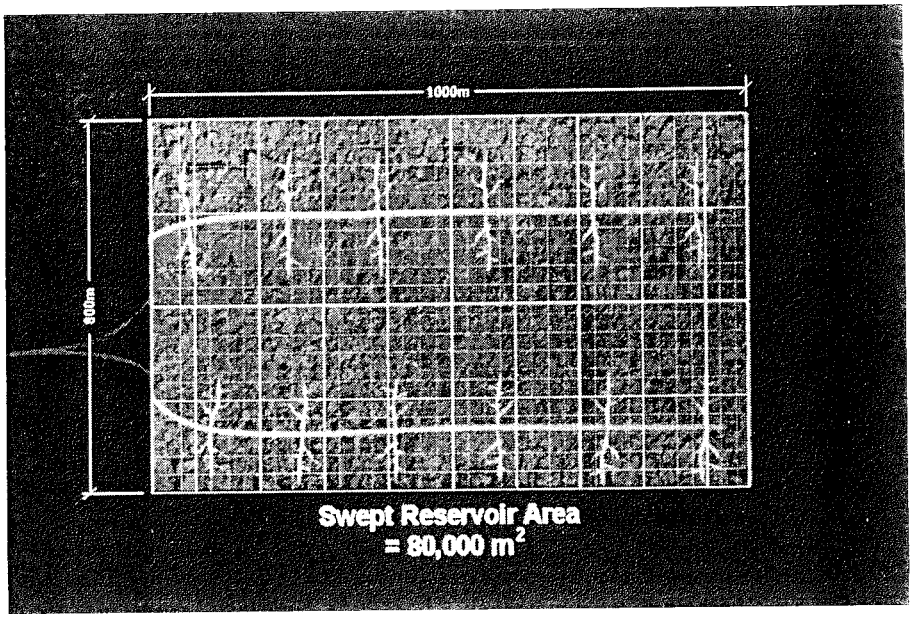
FIG. 38 is a plan view of a hypothetical dual horizontal wellbore configuration with an overlay showing the swept reservoir area.
Figure 39:
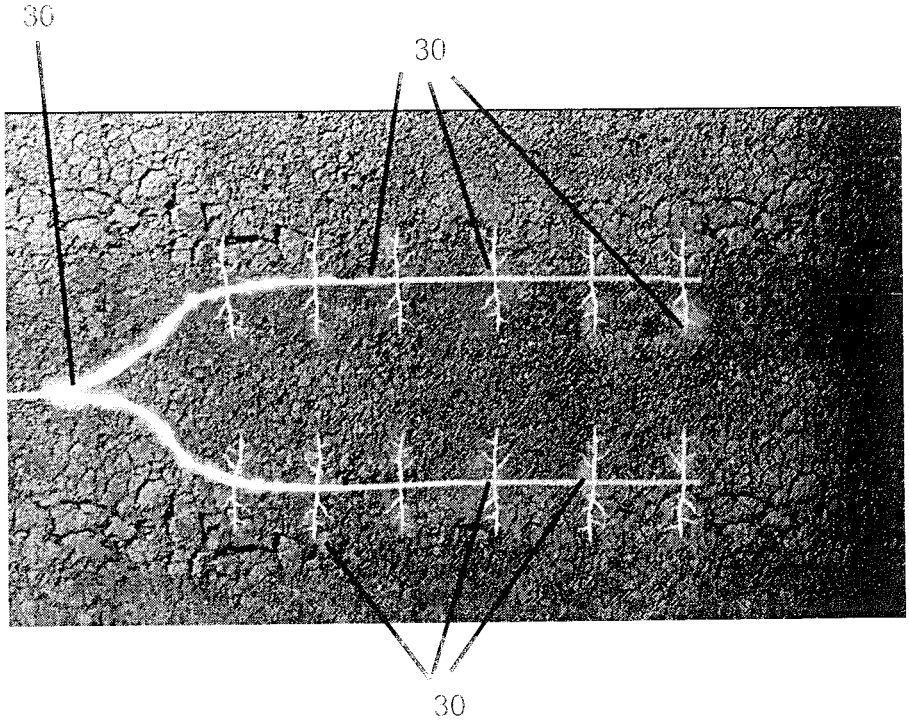
FIG. 39 is a plan view showing production/flow of hydrocarbons or gas from fractures into the dual horizontal wellbore.

FIG. 35 shows that vertical or deviated wellbores 38 can be created from a horizontal wellbore 2 in accordance with the methods of the present invention in order to create a further dendritic fracture pattern in the subterranean formation. Such a wellbore and fracture pattern can be used to increase the production of hydrocarbons or gas 30 from a well site, as shown in FIG. 36. In particular, by having, for instance, a dual wellbore configuration, as shown in FIG. 37 that is 1000 m in length, with each such wellbore having fractures that extend 200 m both above and below each wellbore, the reservoir drainage area increases significantly to approximately 80,000 $m^2$ (see FIG. 38). FIG. 39 shows how each fracture in a dual wellbore contributes to the overall production of the well.

What is claimed is:

1. A method of drilling and completing a wellbore in a subterranean formation for the recovery of hydrocarbon or natural gas resources comprising the steps of:

(i) drilling a wellbore of intermediate depth in a subterranean formation by means of a drill string;

(ii) inserting a frac string into the wellbore and pumping into the wellbore through an opening in the frac string an isolation fluid that is sufficient to withstand fracture initiation pressure;

(iii) pumping into the wellbore through an opening in the frac string a frac fluid at a pressure sufficient to create fractures in the subterranean formation in the vicinity of the end of the frac string;

(iv) removing the frac string from the wellbore;

(v) inserting the drill string into the wellbore and through the isolation fluid to flow any residual frac fluid and the isolation fluid back out of the wellbore; and (vi) extending the wellbore by means of the drill string, whereby hydrocarbon or natural gas resources flow from the fractures into the wellbore for the recovery thereof while drilling proceeds, and whereby steps (ii) to (vi) are repeated throughout the entire length of the wellbore to create multi-fractured zones in the wellbore that cumulatively add to the recovery of hydrocarbon or natural gas resources.

* * * * *